US007318331B2

(12) United States Patent
Miao

(10) Patent No.: US 7,318,331 B2
(45) Date of Patent: Jan. 15, 2008

(54) COMBINATION LOCK HAVING A KNOB ROTATABLY MOUNTED THEREIN TO ACTIVATE/DEACTIVATE THE LOCKING MECHANISM OF THE COMBINATION LOCK

(75) Inventor: Tony Miao, Taipei Hsien (TW)

(73) Assignee: Jin Tay Industries Co., Ltd., Taishan Hsien, Taipei Hsien, Taowam ( * ) Notice: Subject to any disclaimer, the term of this patent is extended or adjusted under 35 U.S.C. 154(b) by 174 days.

(21) Appl. No.: 11/388,960

(22) Filed: Dec. 28, 2005

(65) Prior Publication Data

US 2007/0144226 A1 Jun. 28, 2007

(51) Int. Cl.
*E05B 37/16* (2006.01)

(52) U.S. Cl. ..... 70/214; 70/298; 70/315; 70/333 R

(58) Field of Classification Search ..... 70/213–214, 70/297–299, 315, 317, 333 R
See application file for complete search history.

(56) References Cited

U.S. PATENT DOCUMENTS 3,115,028 A * 12/1963 Windle ..... 70/288
4,671,084 A * 6/1987 Lin ..... 70/298
4,748,833 A * 6/1988 Nagasawa ..... 70/214
4,936,894 A * 6/1990 Larson et al. ..... 70/298
6,272,889 B1 * 8/2001 Burleigh et al. ..... 70/297
6,334,346 B1 * 1/2002 Wang ..... 70/214
6,598,434 B2 * 7/2003 Yang ..... 70/213
7,043,948 B1 * 5/2006 Wang ..... 70/214
2004/0261477 A1 * 12/2004 Wang ..... 70/214
2005/0210937 A1 * 9/2005 Okuda ..... 70/214

* cited by examiner

*Primary Examiner*—Jennifer H. Gay
*Assistant Examiner*—Christopher Boswell
(74) *Attorney, Agent, or Firm*—Charles E. Baxley

(57) ABSTRACT

A combination lock has a plurality buttons movably received in the casing and a knob rotatably received in the casing. When specific buttons are pressed downward, rotating the knob from a first position to a second position, the balls in the downward movement buttons are limited in the limiting holes in the buttons by the abutting faces of a frame. Rotating the knob to a third position allows pins of the pressed buttons to be secured and limited in the longitudinal paths. Pressing the returning rod is able to release the arms which are received in the arm stays in the pressed arms. Rotating only the core relative to the combination of the rotator and the body is able to drive the second abutting block to move so as to return all the pins back to their original positions to be ready for next use.

13 Claims, 16 Drawing Sheets

COMBINATION LOCK HAVING A KNOB ROTATABLY MOUNTED THEREIN TO ACTIVATE/DEACTIVATE THE LOCKING MECHANISM OF THE COMBINATION LOCK

BACKGROUND OF THE INVENTION

1. Field of the Invention

The present invention relates to a combination lock, and more particularly to a combination lock having therein a knob rotatably mounted on the lock to activate/deactivate the locking mechanism of the lock.

2. Description of the Prior Art

In public places, such as the train station, the Gray Hound station or the Supermarkets and the malls, a large number of storage boxes are installed for users to temporarily store therein personal items. This kind of storing boxes normally has a built-in unlocking mechanism so that when the key to the storing box is lost or for any unknown reasons the key to the specific storing box is lost, the supervisor may always unlock the storing box. However, there is no way that the responsible authority is able to monitor all the users of the storing boxes, so that some users may copy the keys to the storing boxes when and even after they rent the storing boxes. Then these people may use the copied keys to unlock the storing boxes and steal whatever the items received inside the storing boxes.

To overcome the shortcomings, the present invention tends to provide an improved lock to mitigate the aforementioned problems.

SUMMARY OF THE INVENTION

The primary objective of the present invention is to provide an improved combination lock having a knob mounted on the lock to control the locking/unlocking mechanism of the combination lock. The knob is both controlled by a series of combination numbers and a master key. Therefore, no matter what the combination to the lock is set, the supervisor may always use the master key to reset the locking mechanism so as to return the locking mechanism to its original status to be ready for next use.

In order to accomplish the foregoing objective, the lock of the present invention includes a plurality of buttons movably mounted on a returning seat which is linearly movable relative to a casing of the lock, a limiting seat movably received in the casing and operatively connected to the buttons and a knob rotatably mounted in the casing and having thereon multiple abutting bosses to selectively move the limiting seat and the returning seat. Therefore, when the buttons are pressed downward from a first position to a second position after the knob is rotated in a first direction to force the first abutting boss thereof to move the limiting seat as well as the returning seat from a first position to a second position, arms from the returning seat will be received in the cutouts defined in the buttons which are pressed to maintain the specific buttons in the second position. Due to the engagement between the returning seat and the specific buttons, the returning seat is also maintained in the second position. In addition, rotating the knob in the second direction which is opposite to the first direction, the limiting seat is moved back to its first position by the recoil force from the springs which are provided between the casing and the limiting seat, which allows the pins of the buttons to be freely movable axially relative to the limiting seat. As a result of moving the returning seat by the second abutting boss, arms from the returning seat are released from the cutouts of the buttons. The pins are then limited by the limiting seat and the combination lock is in the locked status.

Furthermore, a returning rod is movably mounted on the casing and operably connected to the returning seat such that when the specific buttons are in the second position, pressing the returning rod allows the pins of the buttons to be released from the limiting seat.

Still further, a master key is provided to the knob having therein a core. Therefore, when the combination lock is in the locked status, rotating the master key in the core, the second abutting boss forces the returning seat and a frame, which allows the pins of the specific buttons to go back to their original positions. That is, the combination lock is ready for next use.

Other objects, advantages and novel features of the invention will become more apparent from the following detailed description when taken in conjunction with the accompanying drawings.

DETAILED DESCRIPTION OF THE PREFERRED EMBODIMENT

Figure 1:
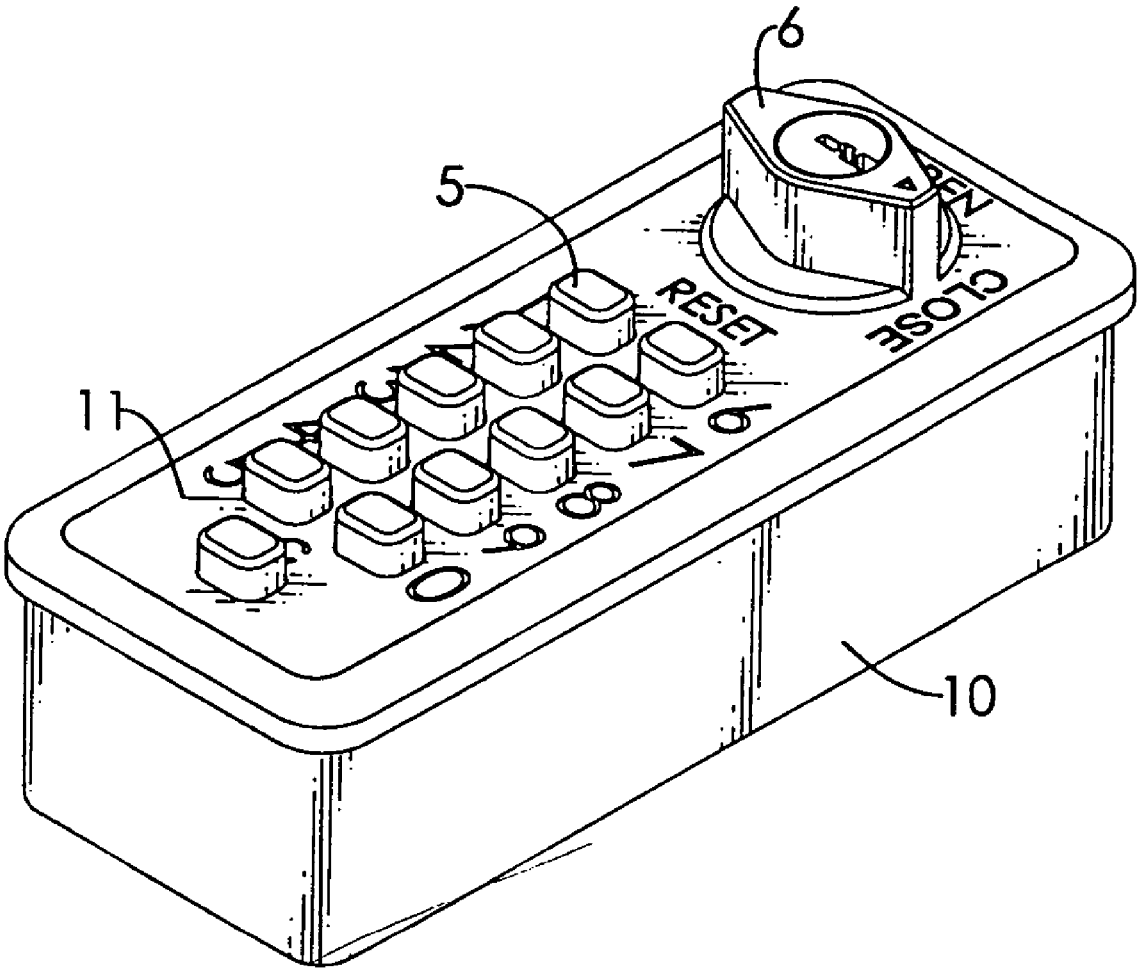
FIG. 1 is a perspective view of the combination lock constructed in accordance with the present invention.
Figure 2:
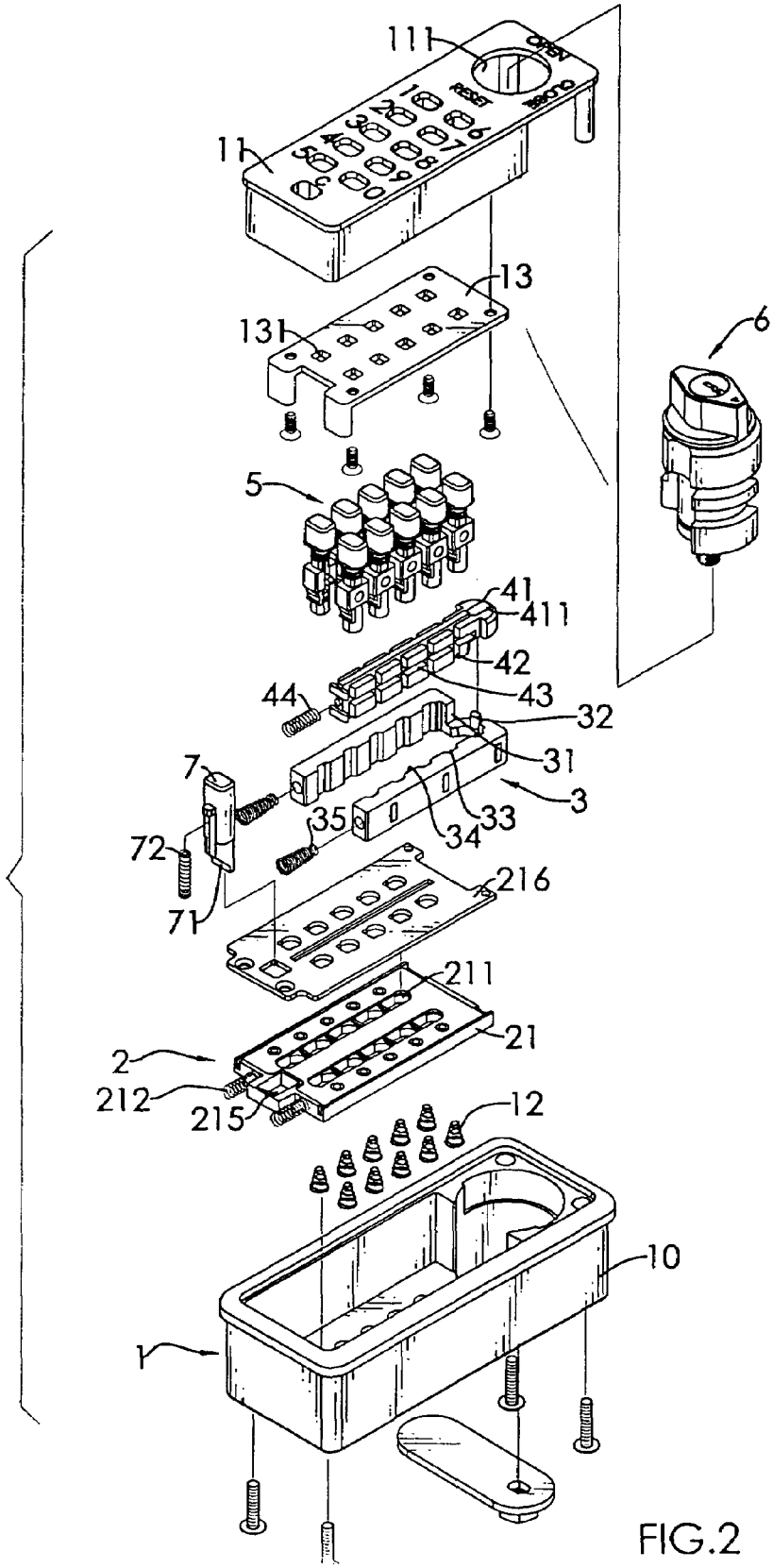
FIG. 2 is an exploded perspective view of the combination lock in FIG. 1.

With reference to FIGS. 1 and 2, it is noted that the combination lock in accordance with the present invention includes a casing (1), a returning seat (2), a frame (3), a limiting seat (4), buttons (5) and a knob (6).

The casing (1) is composed of a bottom casing (10) and a top casing (11) securely connected to the bottom casing (10) to define therebetween a receiving space (not numbered) to receive therein the returning seat (2), the frame (3), the limiting seat (4), the buttons (5) and the knob (6). Multiple first springs (12) are provided inside the receiving space to provide resilience force to the buttons (5). Furthermore, the top casing (11) is provided with an aperture (111) to receive therein the knob (6).

Figure 2A:
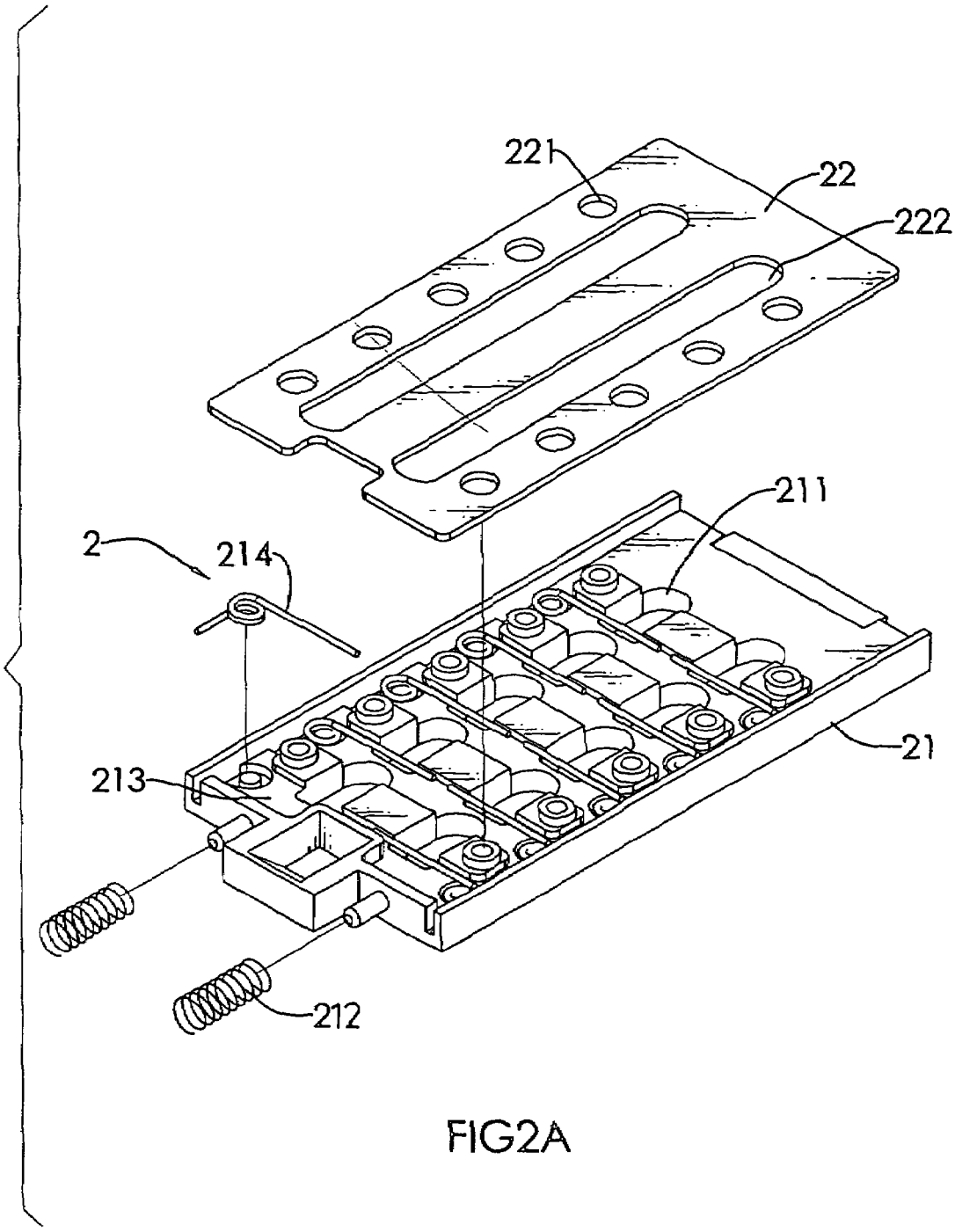
FIG. 2A is an exploded perspective view of the returning seat of the present invention.

The returning seat (2) is securely yet movably received in the receiving space of the casing (1) and composed of a base (21) and a covering (22). The base (21) has multiple first holes (211) defined through the base (21) to correspond to the first springs (12) respectively and first recoil springs (212) (two are shown) provided between a side face of the base (21) and an inner side face defining the receiving space of the casing (1). The returning seat (2) is further depicted in FIG. 2A, in which the returning seat (2) has multiple seats (213) formed on the base (21). Each first hole (211) has a corresponding seat (213) formed nearby. An arm (214) is securely provided on each of the seats (213) and a free end of each of the arms (214) is extended across the corresponding first holes (211). The covering (22) has multiple second holes (221) defined through the covering (22) to correspond to the seats (213) of the base (21) and two passages (222) horizontal with respect to each other.

The frame (3) has a U shape configuration and includes a first cutout (31) defined in a side face thereof, a rod (32) formed on a bottom face defining the first cutout (31), multiple second cutouts (33) defined in two opposite inner side faces of the frame (3), multiple abutting faces (34) each being formed between two adjacent second cutouts (33) and multiple (two are shown) second recoil springs (35) provided between the inner side face of the casing (1) and a side face of respective distal end of the frame (3).

The limiting seat (4) has a head (41) formed on a front portion thereof and provided with an elongated slot (411) defined through the head (41) to movably receive therein the rod (32) of the frame (3), multiple longitudinal paths (42) defined in two opposite side faces of the limiting seat (4) and a latitudinal path (43) defined in the two opposite side faces to bisect the longitudinal paths (42) and a third recoil spring (44) provided between the rear of the limiting seat (4) and the inner side face of the casing (1) to provide a recoil force to the limiting seat (4).

Figure 2B:
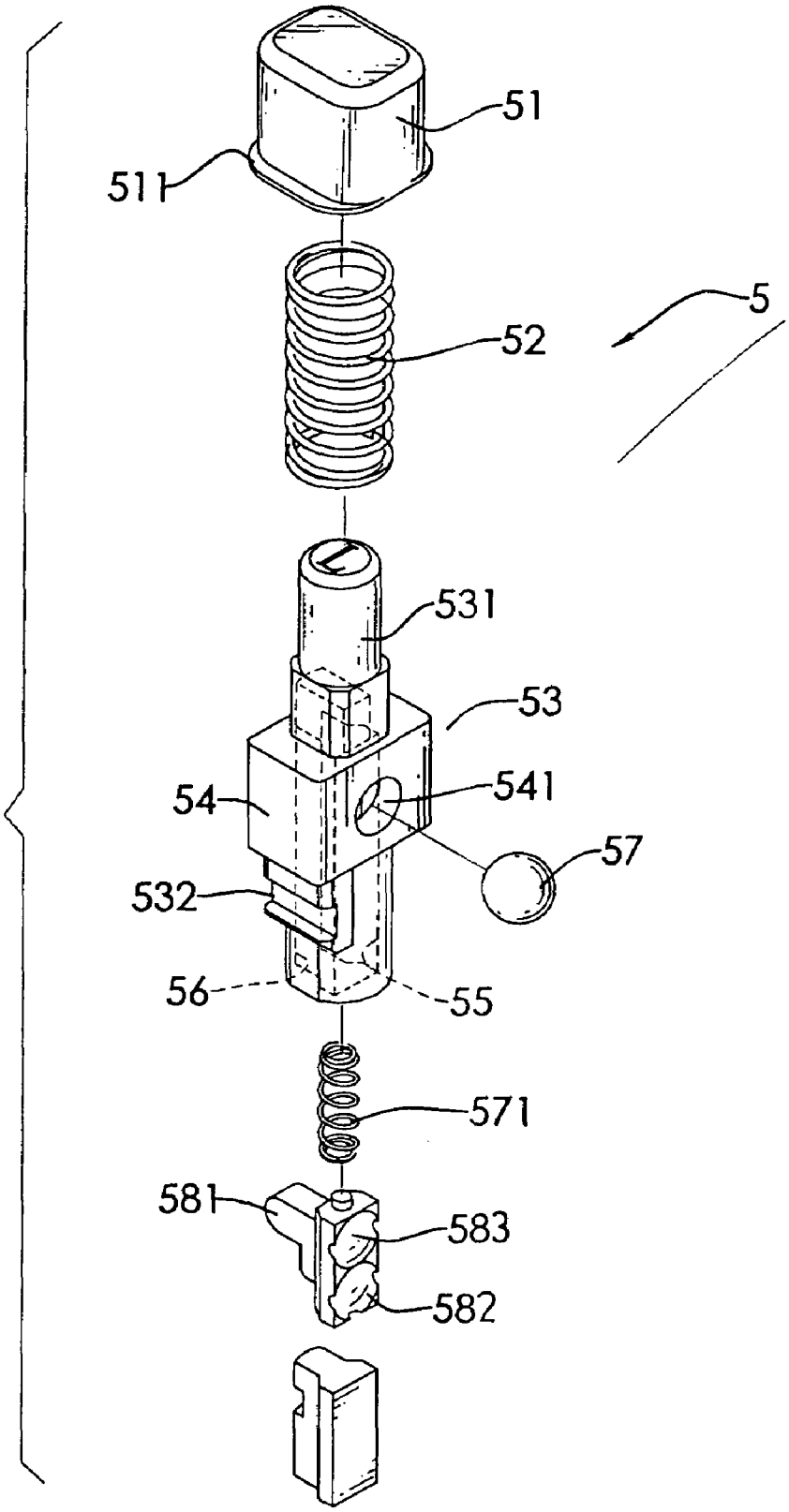
FIG. 2B is an exploded perspective view of the button of the combination lock of the present invention.

Each of the buttons (5) is the same in composition and depicted in detail in FIG. 2B such that only one button (5) is introduced. The button (5) includes a cap (51), a second spring (52) partially received in the cap (51), a column (53) with an extension (531) extending from a block (54) in two different directions and a top portion thereof being formed to support an end of the second spring (52) and a bottom portion thereof being provided with an arm stay (532), i.e. a cutout, a channel (55) defined in the extension (531), an opening (56) defined in a side face of the column (53) to communicate with the channel (55), a ball (57) movably received in the column (53) and selectively extended out of a limiting hole (541) defined in a side face of the block (54), a fourth recoil spring (571) received in the channel (55) to abut the ball (57), a stop (58) movably received in the channel (55) and having a pin (581) extending out of the stop (58) and the opening (56) and provided with two positioning recesses, i.e. a first positioning recess (582) and a second positioning recess (583), to respectively receive therein the ball (57) and a plug (59) securely received in the channel (55) to cover a bottom opening of the channel (55). It is noted that after assembly of the button (5), the first springs (12) are sandwiched between the stop (58) and a top face of the bottom casing (10) to provide a recoil force to the column (53).

Figure 2C:
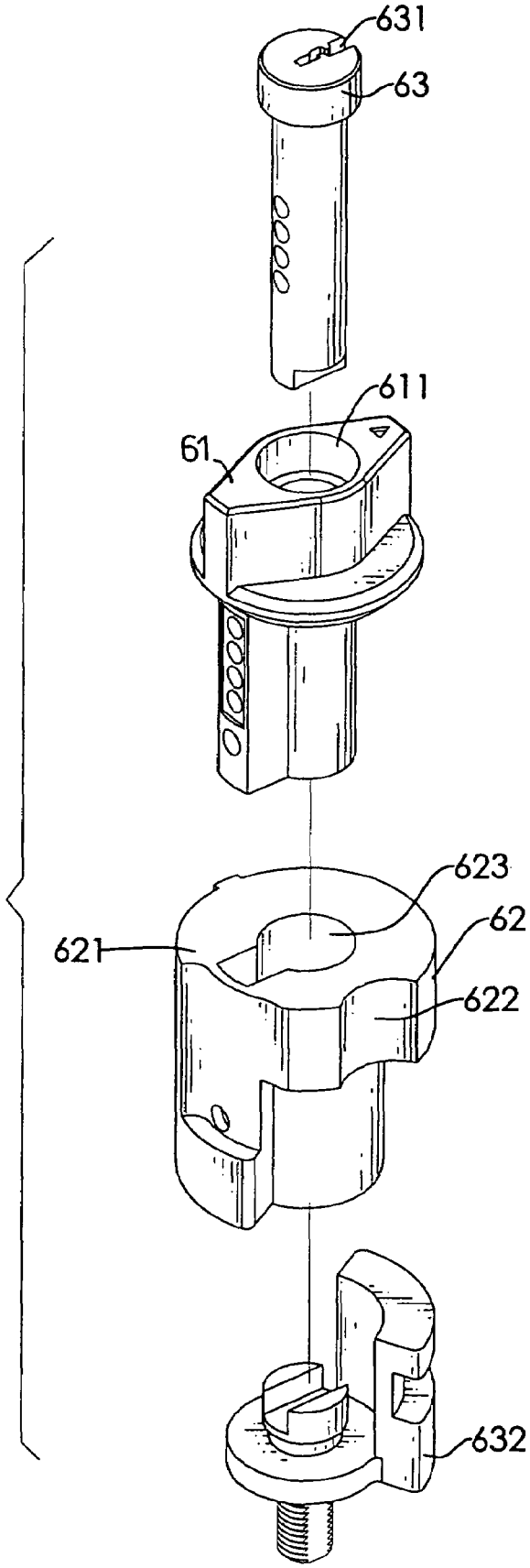
FIG. 2C is an exploded perspective view of the knob of the combination lock of the present invention.

The knob (6) is depicted in detail in FIG. 2C and composed of a rotator (61) and a body (62) firmly engaged with the rotator (61) and having a first abutting block (621) integrally formed on the body (62) and an abutting recess (622) defined in an outer periphery of the first abutting block (621). The rotator (61) has a first passage (611) and the body (62) has a second passage (623) in communication with the first passage (611). In addition, the rotator (61) has an extension (not numbered) extended into the second passage (623). The extension of the rotator (61) is configured in such a way that after the extension is received in the second passage (623), there is no relative movement therebetween. That is, when the rotator (61) is rotated, the body (62) is also rotated. Due to the communication between the first passage (611) and the second passage (623), a core (63) is able to be inserted into the first passage (611) and a free end of the core (63) is flush with a top face of the rotator (61). The core (63) has a keyhole (631) and an extension extending out of the body (62) and provided with a second abutting block (632) formed on an outer periphery of the extension of the core (63).

A protection cap (13), as shown in FIG. 2, is provided on top of the buttons (5) and has third holes (131) defined to correspond to the buttons (5) such that each of the buttons (5) is able to extend out of the third holes (131) yet retained below the protection cap (13) due to the formation of a flange (511) on a bottom periphery of the cap (51). That is, the diameter defined by the flange (511) is larger than that of the third hole (131) of the protection cap (13).

In addition, a returning rod (7) is provided to the returning seat (2). The returning rod (7) has a wedged head (71) formed on a bottom end thereof and a fifth recoil spring (72) an end of which is securely abutted to the returning rod (7). In correspondence to the returning rod (7), the returning seat (2) is provided with a wedged recess (215).

When the combination lock of the present invention is assembled, taking reference to FIGS. 1 to 2C, the bottom portions of the columns (53) of the buttons (5) extend through a securing cap (216) which is on top of the returning seat (2), the passages (222) and the first holes (211) of the returning seat (2) to be supported by the first springs (12) which are received in the bottom casing (10). In the meantime, the limiting seat (4) is received in the frame (3) with the rod (32) being received in the elongated slit (411) of the limiting seat (4) so as to allow the limiting seat (4) to be movable relative to the frame (3) and vice versa. After the combination between the returning seat (4) and the frame (3), each of the buttons (5) is extended through the combination of the returning seat (4) and the frame (3) with the returning seat (4) separating the buttons (5) into two parts, e.g. right part and left part. Then the protection cap (13) is firmly mounted on top of the buttons (5) to secure the positions of the buttons (5) inside the bottom casing (10). Thereafter, the returning rod (7) is inserted through the protection cap (13) with the fifth recoil spring (72) sandwiched between the returning rod (7) and a periphery of the wedged recess (215). That is, the returning rod (7) is supported by the returning seat (2). In the end, the knob (6) is inserted into the bottom casing (10) with the head (41) of the limiting seat (4) being received in the abutting recess (622) of the first abutting block (621). Furthermore, the first recoil springs (212) for the returning seat (2), the second recoil springs (35) for the frame (3) and the third recoil spring (44) for the limiting seat (4) are all placed in position inside the receiving space of the casing (1) to respectively provide a recoil force to the returning seat (2), the frame (3) and the limiting seat (4).

Figure 3A:
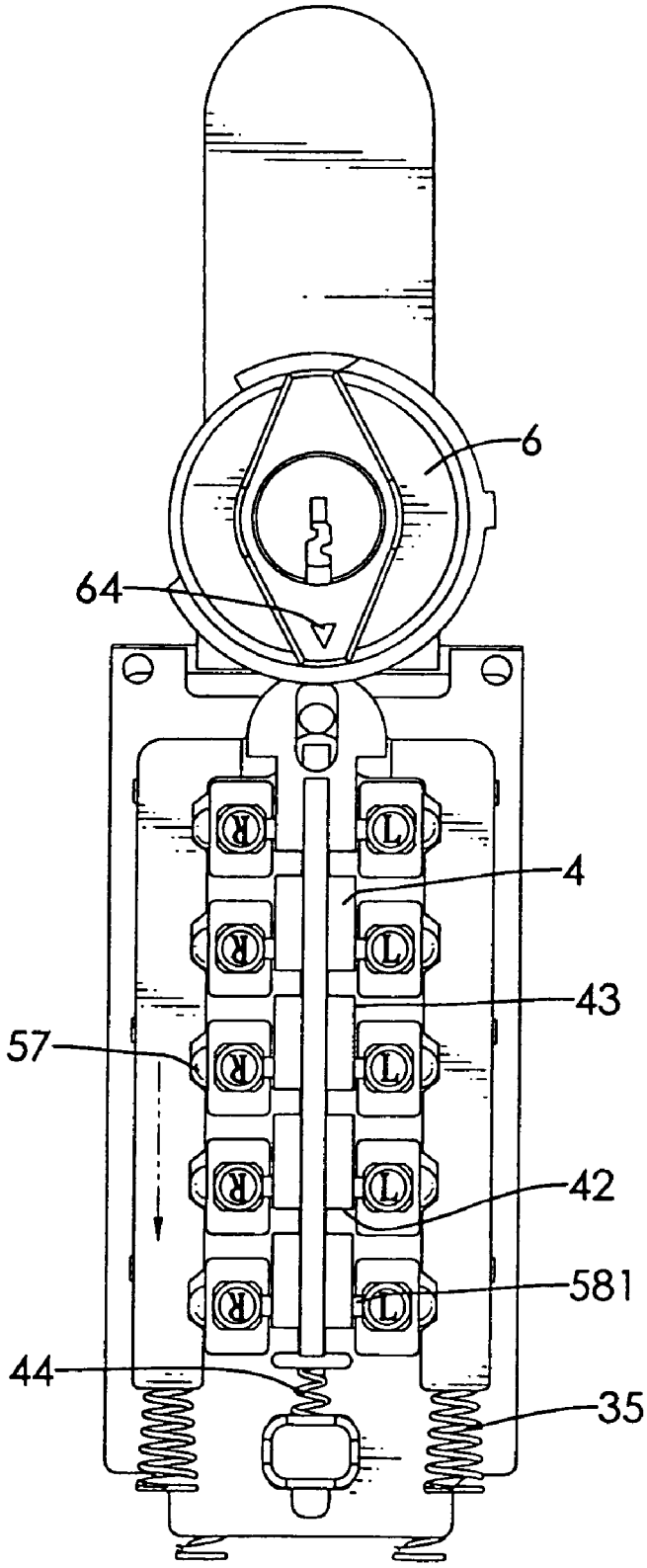
FIG. 3A is a schematic top plan view of the original status of the combination lock of the present invention.

With reference to FIG. 3A, which is an original status of the combination lock of the present invention without setting sequence of the combination, it is noted that all the pins (581) of the buttons (5) are received in the latitudinal path (43) and away from a joint between the latitudinal path (43) and the longitudinal paths (42). Also, the balls (57) of the buttons (5) are received in the second cutouts (33) of the frame (3). From the depiction of the drawing, it is noted that the knob (6) has an indicator (64), an arrow, formed on the rotator (61) and the indicator (64) is pointing at a status designated as a reset phase, where the operator is able to set a specific sequence of number to activate the locking mechanism of the combination lock.

Figure 3B:
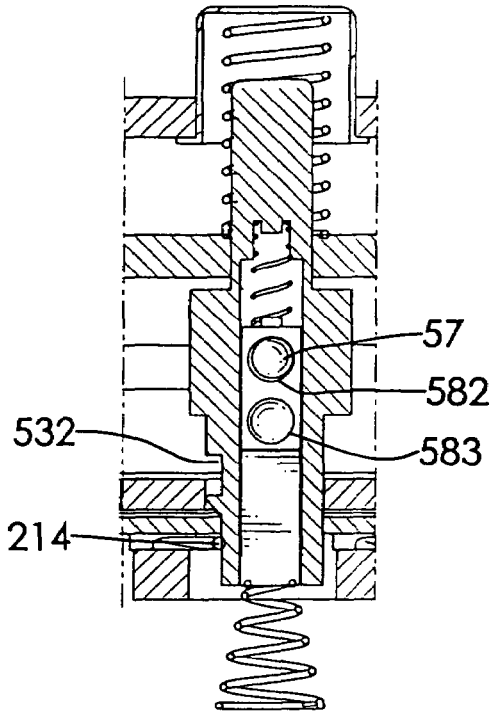
FIG. 3B is a schematic cross sectional view showing the relationship between the arm and the button.
Figure 3C:
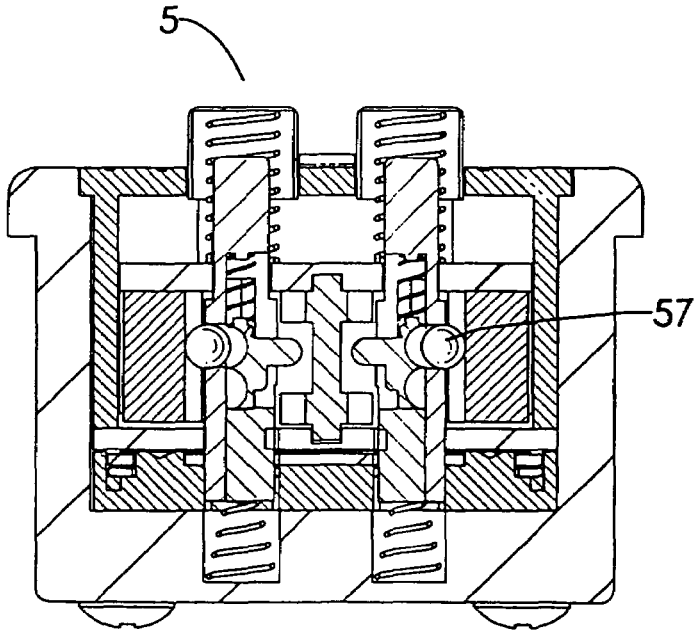
FIG. 3C is a schematic cross sectional view showing the position of the balls inside the buttons.

With reference to FIG. 3B, before setting any number, the arms (214) of the returning seat (2) are respectively located at an outer periphery defining the arm stay (532) of each of the buttons (5), while each of the balls (57) are received in the second positioning recesses (583) of the buttons (5). As shown in FIG. 3C, the balls (57) are in the second positioning recesses (583) before the buttons (5) are pressed. Therefore, it is concluded that before setting any number to the combination lock of the present invention, because all the pins (581) are located in the latitudinal path (43) and away from the joint of the latitudinal path (43) and the longitudinal path (42), the knob (6) can be freely rotated to force the limiting seat (4) and the frame (3) to move inside the casing (1) as a result of the engagement of first abutting block (621) with the head (41) of the limiting seat (4).

In a Status of Setting Numbers for the Combination Lock

Figure 4A:
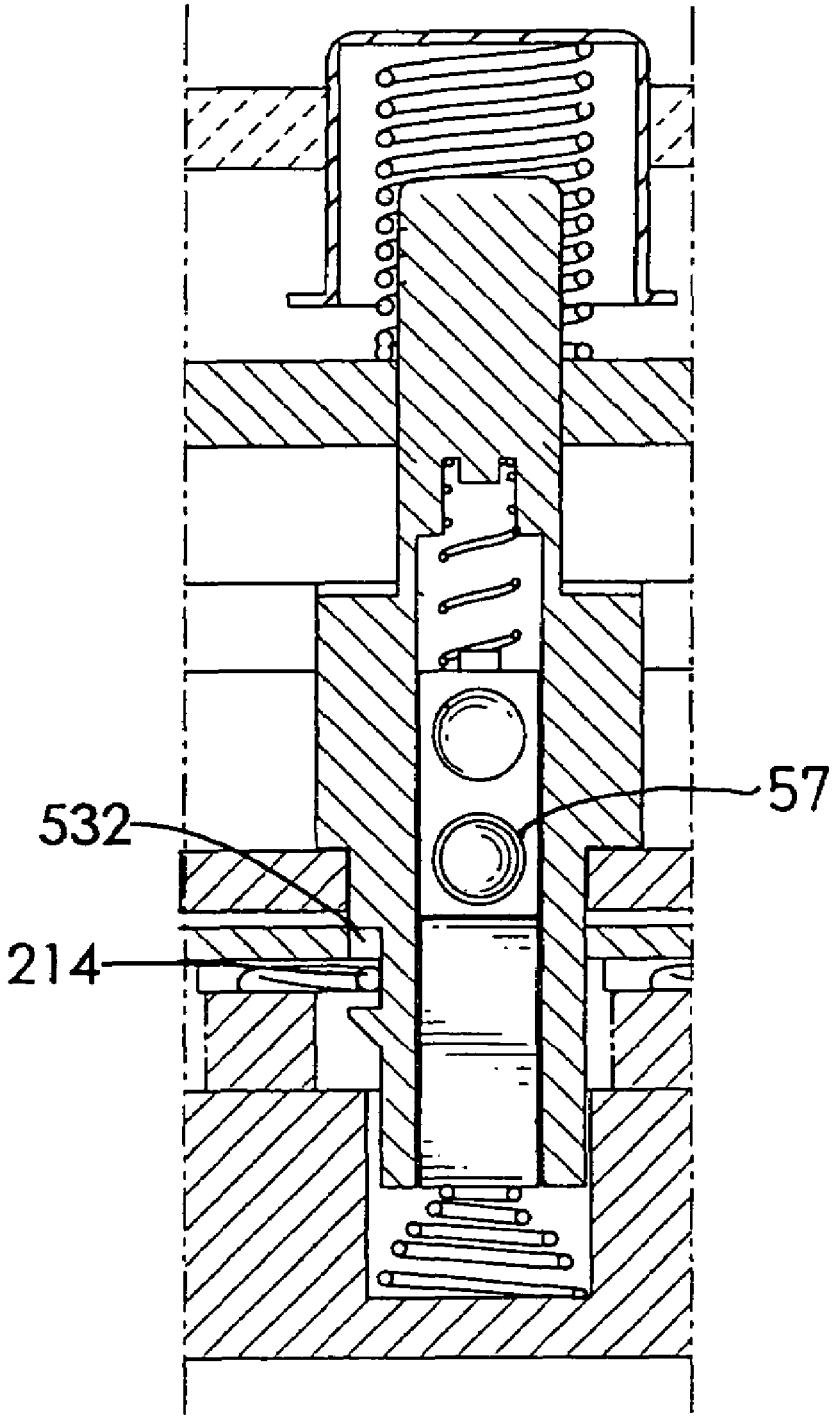
FIG. 4A is a schematic cross sectional view showing that the arm is received in the arm stay of the button after the button is pressed downward relative to the casing.
Figure 4B:
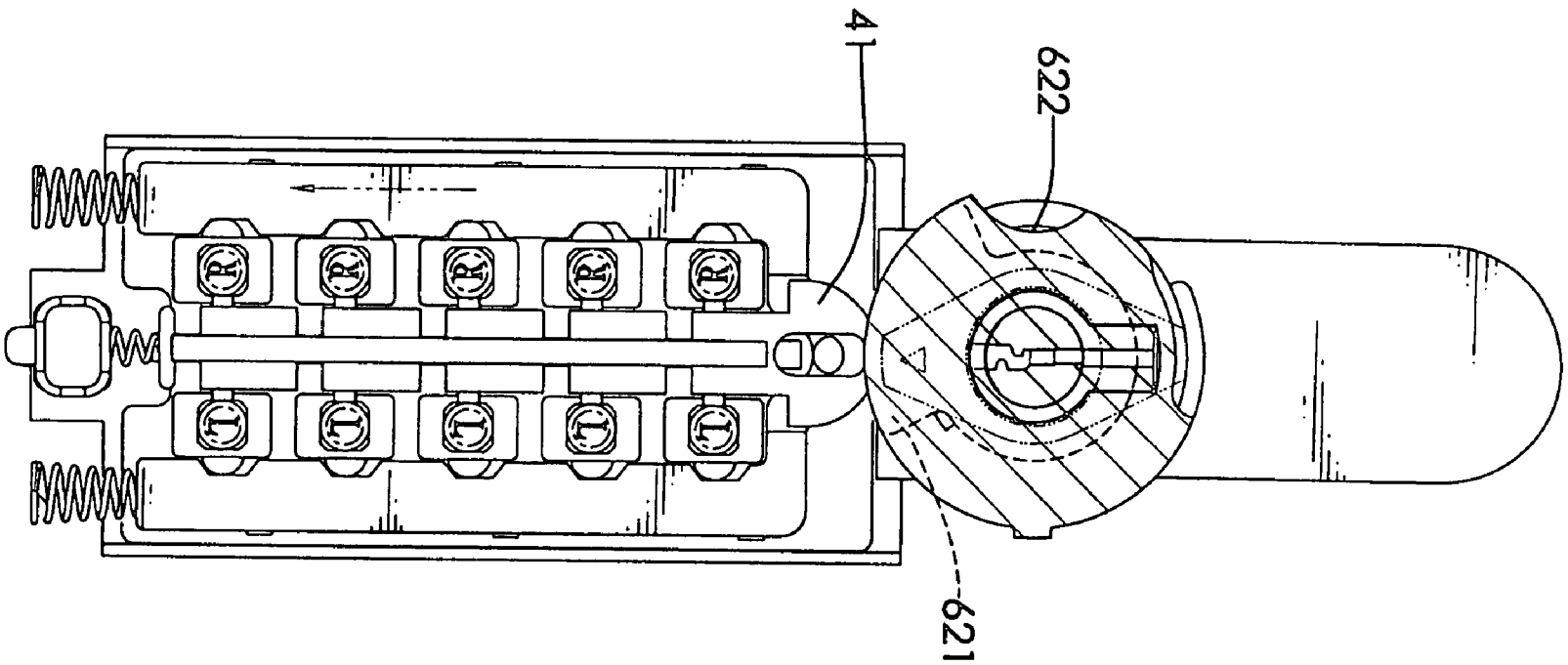
FIG. 4B is a schematic top plan view showing that the head of the frame is away from the abutting recess and the first abutting block is engaged with the head.
Figure 4C:
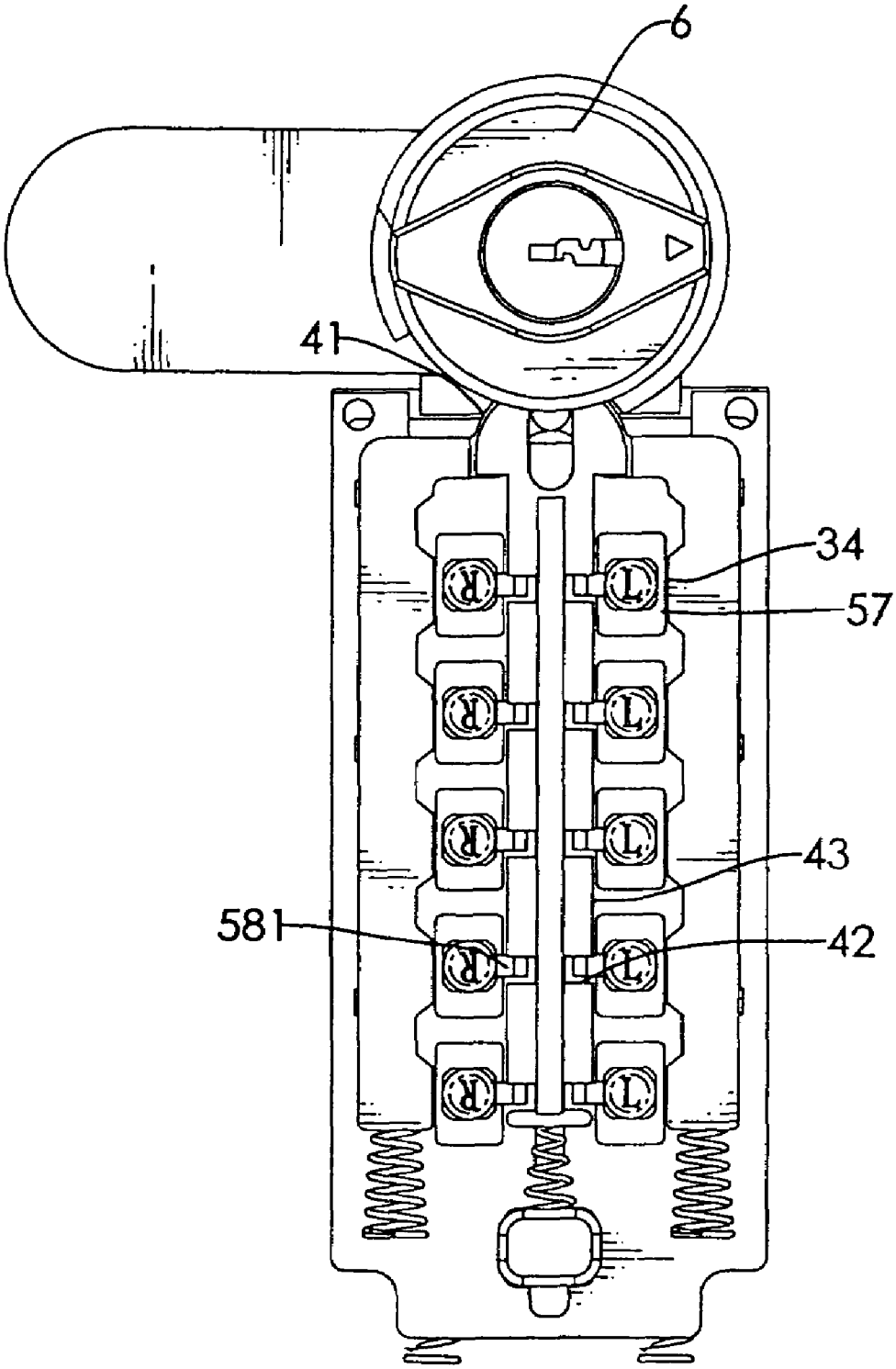
FIG. 4C is a schematic top plan view showing the consequence after the knob is rotated counterclockwise from the original position to a second position.
Figure 4D:
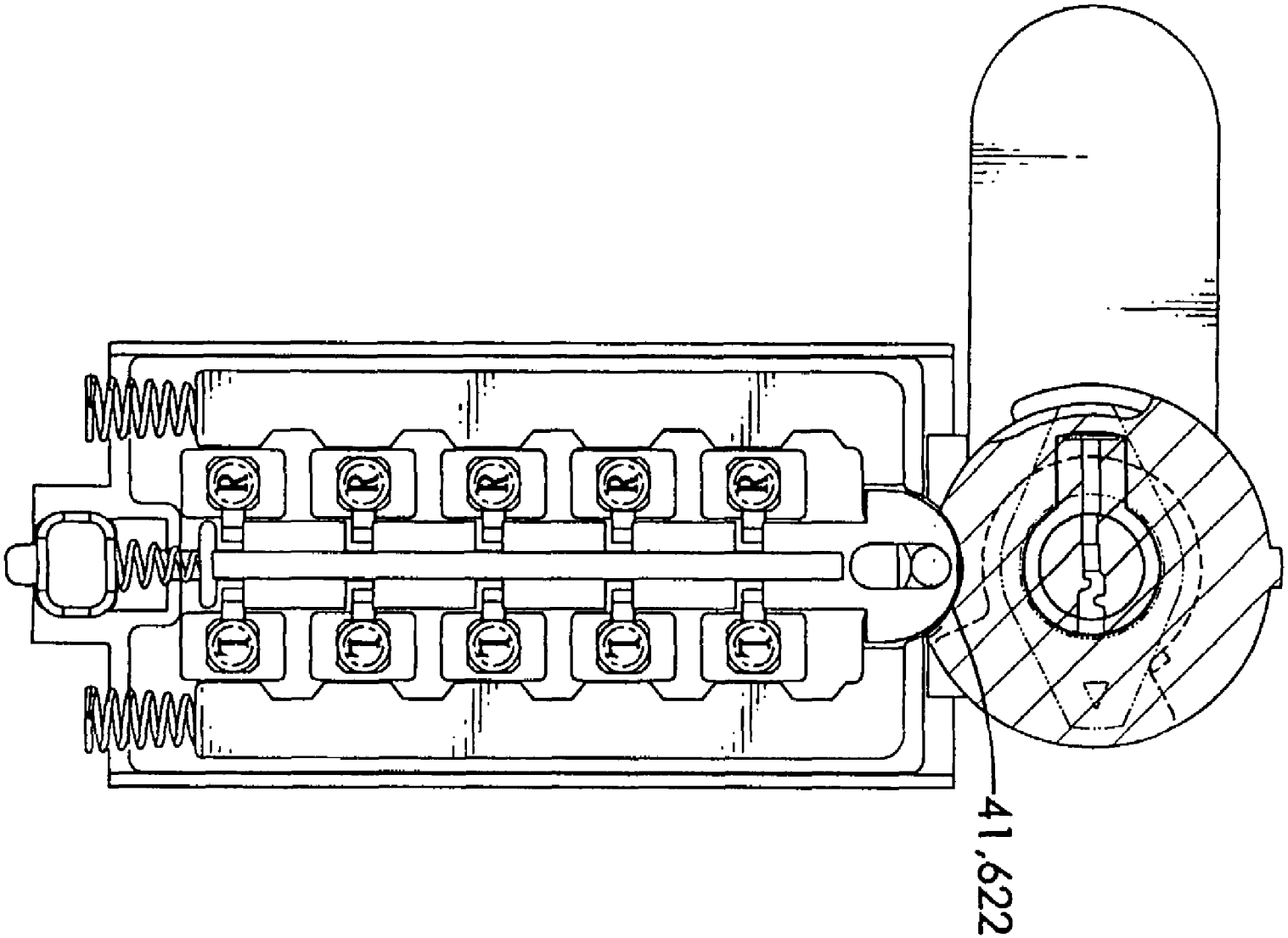
FIG. 4D is a schematic top plan view showing that the head is received in the abutting recess of the first abutting block of the knob.

With reference to FIGS. 4A, 4B and 4C, in an original status for setting a number sequence, it is noted that the knob (6) is at a position where the head (41) of the frame (41) is abutted by the first abutting block (621) and the abutting recess (622) is away from the head (41). When some of the buttons (5) are pressed downward relative to the casing (1), all the arms (214) corresponding to the downward movement buttons (5) are thus received in the arm stays (532) of the specific buttons (5) so as to sustain the pressed buttons (5) in a lower position when compared with their original position. Thereafter, rotating the knob (6) counterclockwise, i.e. from a first position to a second position, as shown in FIGS. 4C and 4D, allows the head (41) to be received in the abutting recess (622), which means that the limiting seat (4) is moved relative to the frame (3). After the limiting seat (4) is moved relative to the frame (3), it is noted that all the balls (57), including the balls (57) corresponding to the downward movement buttons (5), are limited in the limiting holes (541) by the abutting faces (34) of the frame (3) and all the pins (581) are located at the joints between the latitudinal path (43) and the longitudinal paths (42). Under such a configuration, the user is about to secure the numbers set in the original status and the numbers set are not allowed to change after the knob (6) is rotated to the second position due to all the balls (57) being pressed into the limiting holes (541). As a consequence of all the balls (57) being limited by the abutting faces (34), the balls (57) will not change their positions from the second positioning recesses (583) to the first positioning recesses (582) even through more buttons (5) are pressed downward relative to the casing (1).

In a Status of Securing the Determined Numbers

Figure 4E:
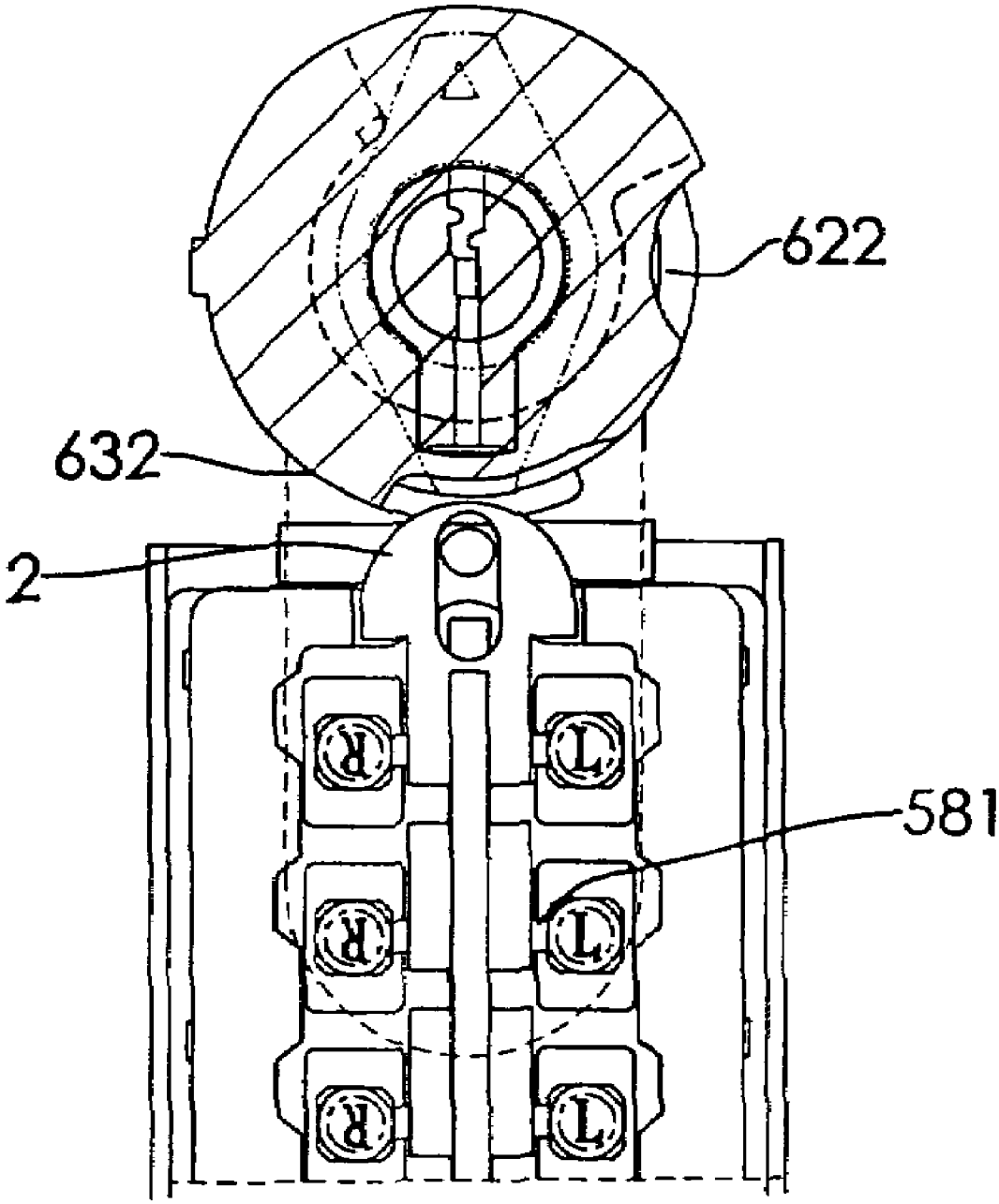
FIG. 4E is a schematic top plan view showing that the knob is rotated from the second position to the third position to allow the second abutting block to engage with the head.

After the knob (6) is rotated to allow the head (41) to be received in the abutting recess (622) so as to allow all the pins (581) to be positioned at the joint of the longitudinal path (42) and the latitudinal path (43), rotating the knob (6) in the counterclockwise direction again, i.e. from the second position to the third position, as shown in FIG. 4E, the second abutting block (632) of the knob (6) triggers the movement of the returning seat (2). That is, the second abutting block (632) is engaged with the returning seat (2) so as to force the returning seat (2) to move inside the casing (1), which allows all the arms (214) to be released from the arm stay (532). At the time when all the arms (214) are released from the arm stay (532), the pins (581) of the buttons (5) being pressed downward relative to the casing (1) are moved into a portion of the longitudinal path (42) above the latitudinal path (43). Then the number sequence of the combination lock is set and the combination lock of the present invention is ON.

Figure 5:
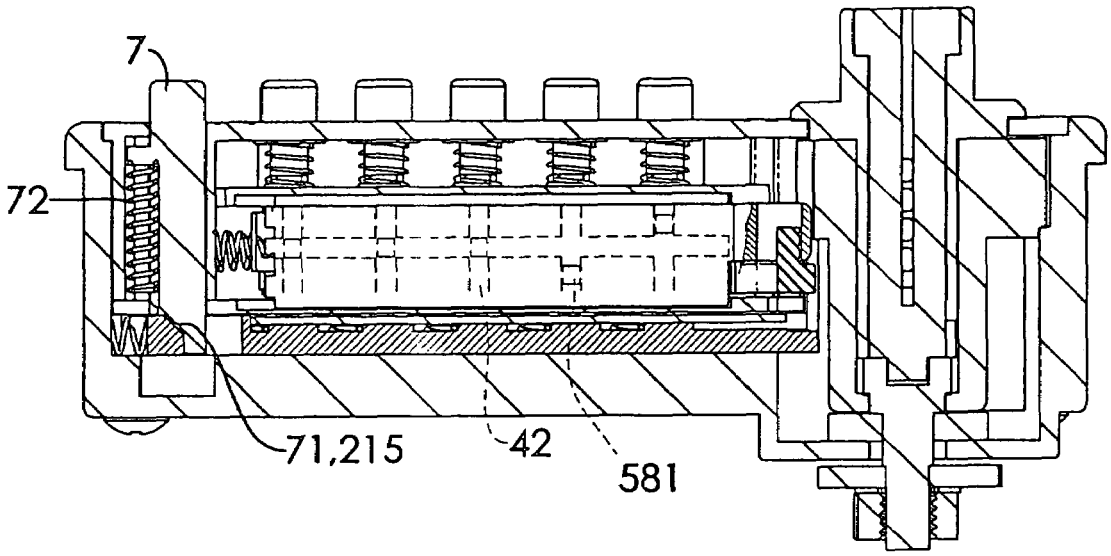
FIG. 5 is a schematic cross sectional view showing the position of the pins.

After the sequence of numbers is set for the combination lock of the present invention, a user is able to use the combination lock to secure safety of personnel belongings in a public places such as train station, bus station, airport or restaurants where public lockers are available. That is, after the personnel belongings are placed into a locker, the user is able to rotate, clockwise, the knob (6) from the third position to the second position, which separates the engagement between the second abutting block (632) and the returning seat (2). Thereafter, it is noted from FIG. 5 that the pins (581) corresponding to the pressed buttons (5) are secured inside the upper half of the longitudinal path (42).

Another method to secure the number sequence of the combination lock of the present invention after some buttons (5) are pressed downward relative to the bottom casing (10) is described in the following. After the arms (214) from the returning seat (2) corresponding to the downward movement buttons (5) are received in the arm stays (532), the user may press downward the returning rod (7) to force the wedged head (71) to abut an outer periphery defining the wedged recess (215) such that the returning seat (2) is forced to move inside the casing (1), which releases the arms (214) from the corresponding arm stays (532). Thus the pins (581) of the selected buttons (5) are moved to the upper half of the longitudinal path (42) by the first springs (12).

Figure 6:
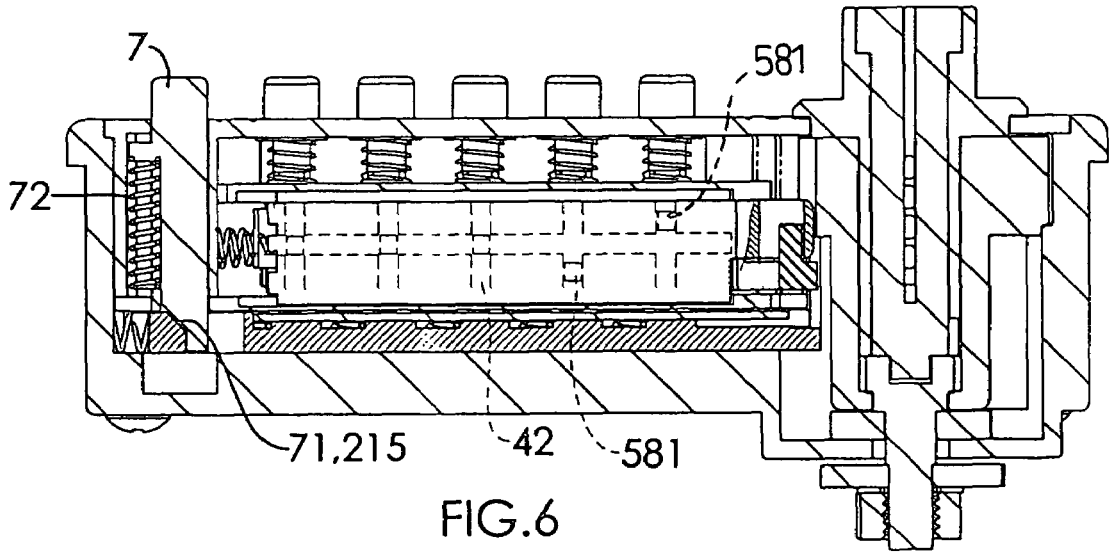
FIG. 6 is a schematic cross sectional view showing the position of the pins after the number sequence is determined and some button are incorrectly pressed.

Further attention is to be noted concerning the movement of the buttons (5). After the selected buttons (5) are secured, i.e. the number sequence is determined and secured and the combination lock is in the locked status, any unauthorized personnel trying to unlock the combination lock by random number sequences may cause the pins (581) of the incorrect buttons (5) be moved to the lower half of the longitudinal path (42), which further locks the combination lock of the present invention. Under such a condition, some of the pins (581) stay in the upper portion of the longitudinal path (42) and some of the pins (581) stay in the lower portion of the longitudinal path (42), as shown in FIG. 6.

Figure 7:
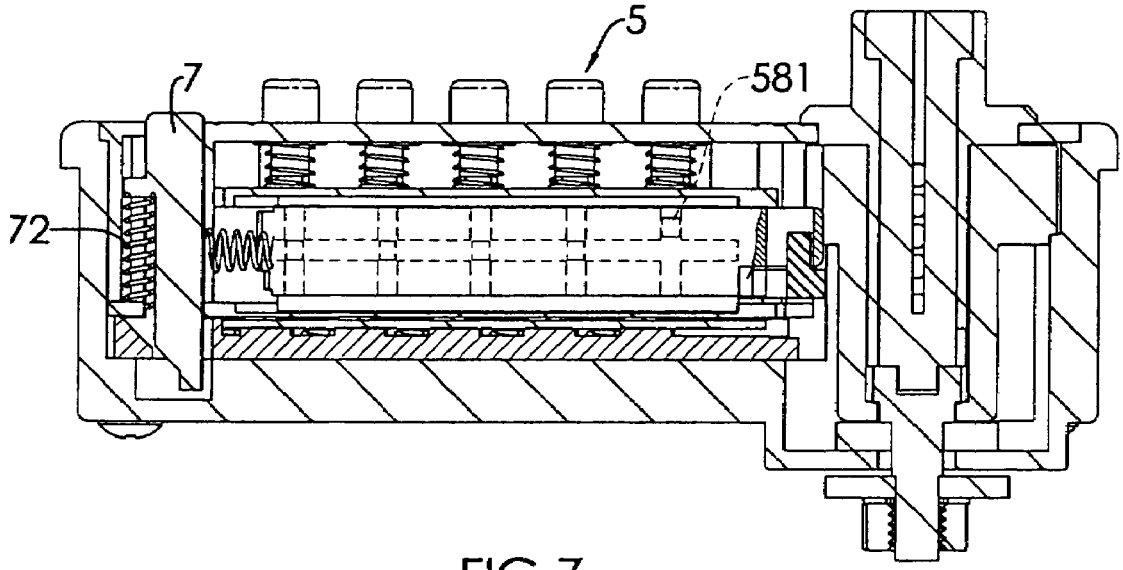
FIG. 7 is a schematic cross sectional view showing the movement of the returning rod allows the number sequence to be determined.

Therefore, with reference to FIG. 7, when a user is trying to open the previously set combination lock of the present invention, the user needs to press the returning rod (7) first to return the pins (581) of the buttons (5) incorrectly pressed back to the joint between the longitudinal path (42) and the latitudinal path (43). Then the user may use the correct combination to unlock the combination lock. Otherwise, the user will not be able to unlock the combination lock even the correct number sequence is used.

In a Status of Erasing All the Number Sequence

Figure 8:
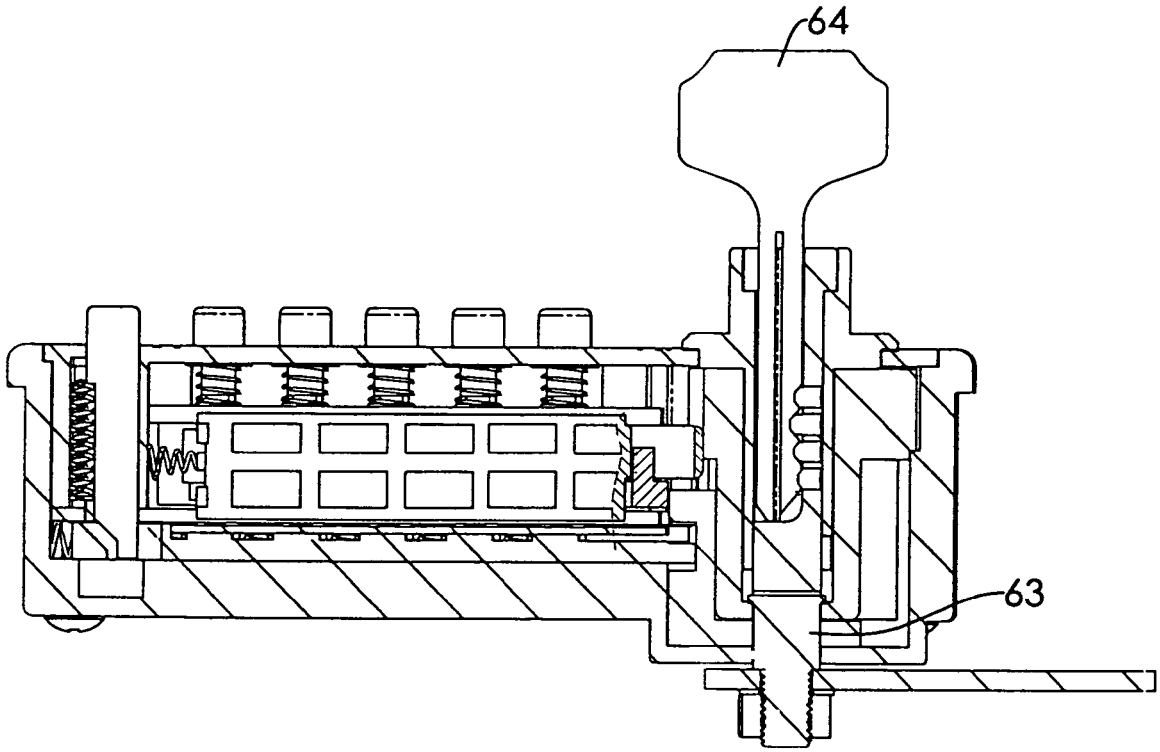
FIG. 8 is a schematic cross sectional view showing the insertion of the master key is able to drive the core to rotate.
Figure 9:
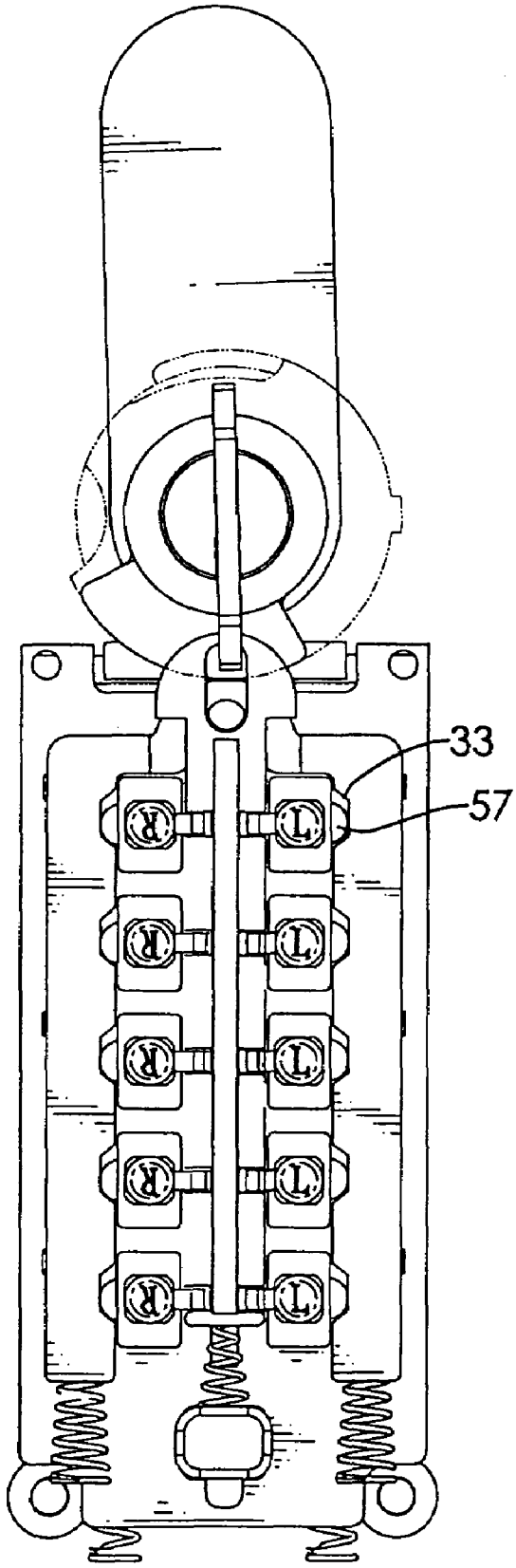
FIG. 9 is a schematic top plan view showing that all the balls are again received in the second cutouts of the frame to allow the user to reset the number sequence.

After the user returns the locker to the supervisor, with reference to FIGS. 8 and 9, the supervisor is able to insert a master key (64) into the keyhole (631) of the core (63) to separate the core (63) from the combination of the rotator and the body (62). Then the user is able to rotate the core (63) to drive the second abutting block (632) to move simultaneously. Due to the rotation of the second abutting block (632), the second abutting block (632) engages with the frame (3) to move the frame (3) relative to the limiting seat (4), which aligns the second cutouts (33) with the balls (57) of the buttons (5). After the alignment between the balls (57) and the second cutouts (33), the fourth recoil springs (571) of the buttons (5) of which the pins (581) are stayed in the upper portion of the longitudinal path (42) provide a recoil force to return all the pins (581) back to the joint between the longitudinal path (42) and the latitudinal path (43). Then the combination lock of the present invention is ready for next use.

From the foregoing description, it is noted that the user is able to safely use the combination lock of the present invention without worrying that the combination sequence is copied by unauthorized personnel after the use of the combination lock and personal belongings will be stolen. Each time when in use of the combination lock, the user is able to randomly select a combination sequence to safeguard the personal belongings and everytime after the use of the combination lock, the supervisor is able to reset the combination sequence so that the user is able to freely select a preferable number sequence.

Even though the previously set number sequence is changed due to an attempt trying to open the combination lock by inputting any number sequence, the press of the returning rod (7) will reset the incorrectly pressed number and then the user may still open the combination lock by inputting the correct number sequence.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination lock comprising:

a casing;

a returning seat movably received in the casing;

a limiting seat linearly movably received in the casing and having a latitudinal path defined in opposite sides of the limiting seat and longitudinal paths defined in the opposite sides of the limiting seat to bisect the latitudinal path;

a frame selectively movable relative to the limiting seat;

buttons selectively and movably received in the casing and operably connected to the limiting seat, each button having a pin extended out therefrom; and a knob rotatably received in the casing among a first position, a second position and a third position, the knob having a rotator and a body combination and a core selectively connected to the combination of the rotator and the body, the combination of the rotator and the body having a first abutting block to selectively move the limiting seat from a first position to a second position to secure the position of the buttons and the core having a second abutting block integrally formed with the core to selectively move the frame relative to the limiting seat to release the buttons such that when the buttons are secured, the combination lock is in a locked status and when the buttons are released, the combination lock is in an unlocked status.

2. The combination lock as claimed in claim 1, wherein first springs are received between the buttons and a face of the casing to provide resilience force to the buttons, first recoil springs are provided between a side face of the casing and the returning seat to move the returning seat back to its original position after the returning seat is moved, second recoil springs are provided between the side face of the casing and the frame to move the frame back to its original position after the frame is moved, and a third recoil spring is provided between the side face of the casing and the limiting frame to move the limiting seat back to its original position after the limiting seat is moved.

3. The combination lock as claimed in claim 2, wherein each button has a column extending from a block in two different directions, a channel defined in a lower half of the column, an opening defined in a side face of the lower half of the column to communicate with the channel, a ball movably received in a limiting hole defined in a side face opposite to the opening and communicating with the channel so as to allow the ball to move in and out of the limiting hole, a stop provided to the channel to close a bottom opening of the channel so as to receive inside the channel a fourth recoil spring between the ball and the stop.

4. The combination lock as claimed in any one of claims 1-3, wherein the returning seat has multiple arms securely received therein and each arm corresponds and abuts a periphery of the buttons so that after the buttons are pressed downward relative to the casing from a first position to a second position, free ends of the arms corresponding to the downward movement buttons are received in arm stays respectively formed on each of the buttons to sustain the downward movement buttons in the second position.

5. The combination lock as claimed in claim 4 further comprising means for releasing the arms from limitation of the arm stays to return the buttons in the second position to the first position after the knob is rotated to allow the first abutting block to move the limiting seat relative to the frame.

6. The combination lock as claimed in claim 5, wherein releasing means comprises a abutting recess defined in a side face of the first abutting block and a head formed on a font portion of the limiting seat so that when the head of the limiting seat is received in the abutting recess, the buttons pressed are in the second position and when the head is away from the abutting recess, the button pressed are in the first position.

7. The combination lock as claimed in claim 6, wherein the limiting seat has multiple longitudinal paths defined in opposite side faces of the limiting seat and a latitudinal path defined in the opposite side faces of the limiting seat to respectively bisect the longitudinal paths, the frame has abutting faces defined in two opposite inner side faces of the frame to limit the balls respectively in the limiting holes and cutouts each defined between two adjacent abutting faces to allow the balls to extend out of the limiting holes.

8. The combination lock as claimed in claim 7, wherein when the knob is at the first position, the pins of the buttons are located and limited in the latitudinal path and away from joints of the latitudinal path and the longitudinal paths and the balls are allowed to extend out of the limiting holes to be received in the cutouts of the frame so that the buttons are allowed to move from the first position to the second position.

9. The combination lock as claimed in claim 8, wherein when the knob is at the second position, the pins of the buttons are at the joints of the longitudinal paths and the latitudinal path as a result of the movement of the limiting seat by the first abutting block relative to the frame.

10. The combination lock as claimed in claim 9, wherein when the knob is at the third position, the pins corresponding to the downward movement buttons are moved by their fourth recoil springs to the longitudinal paths such that number sequence of the combination lock is set.

11. The combination lock as claimed in claim 10 further comprising a returning rod movable received in the casing to operably connect to the returning seat so that when the buttons are moved from the first position to the second position, the movement of the returning rod is able to move the returning seat to a second position from a first position and to release the arms from the downward movement buttons.

12. The combination lock as claimed in claim 11, wherein the returning seat has a wedged recess and the returning rod has a wedged head formed on a free end thereof so that engagement of the wedged head with the wedged recess is able to force the returning seat to move.

13. The combination lock as claimed in claim 12 further comprising a master key selectively inserted into the core to separate the core from the combination of the rotator and the body so that the insertion of the master key is able to drive the core as well as the second abutting block to rotate, which allows the second abutting block to move the frame relative to the limiting seat to return the pins limited in the longitudinal paths back to the joints between the longitudinal paths and the latitudinal path due to a recoil force from the fourth recoil springs received in the pressed buttons.

* * * * *